United States Patent [19]

Soulos

[11] 4,135,715

[45] Jan. 23, 1979

[54] TIMED STACKING GAME

[76] Inventor: Steven T. Soulos, 55 Alfred Drowne Rd., Barrington, R.I. 02806

[21] Appl. No.: 763,227

[22] Filed: Jan. 27, 1977

[51] Int. Cl.[2] ..... A63F 7/00

[52] U.S. Cl. ..... 273/1 R; 35/22 A; 273/120 R

[58] Field of Search ..... 273/118 R, 1 R, 1 E, 273/1 M, 120 R, 120 A, 126 R, 126 A, 127 A, 135 F; 35/22 R, 22 A; 46/43

[56] References Cited

U.S. PATENT DOCUMENTS

| | | | |
|---|---|---|---|
| 197,127 | 11/1877 | Hasbrouk | 273/120 R |
| 269,351 | 12/1882 | Turner | 273/127 A |
| 275,308 | 4/1883 | Williams | 273/127 A X |
| 2,417,641 | 3/1947 | Fischer | 273/120 R X |
| 2,729,020 | 1/1956 | Frampton | 35/22 A X |
| 2,999,689 | 9/1961 | Litwinczuk | 273/120 R X |
| 3,589,724 | 6/1971 | Barlow | 273/1 R |

FOREIGN PATENT DOCUMENTS

| | | | |
|---|---|---|---|
| 29283 of | 1897 | United Kingdom | 273/120 R |

OTHER PUBLICATIONS

Playthings Magazine, Mar. 1961, p. 506, "Building Boom!"

*Primary Examiner*—Paul E. Shapiro
*Attorney, Agent, or Firm*—Salter & Michaelson

[57] ABSTRACT

A game comprising a zig zag trackway through which a ball descends by gravity, said trackway terminating in a straight, downwardly inclined portion having a platform at its terminal end, and a plurality of construction pieces adapted to be stacked on said platform, the idea of the game being to stack a predetermined number of pieces before the ball completes its descent and rolls into the stack to cause same to collapse.

3 Claims, 11 Drawing Figures

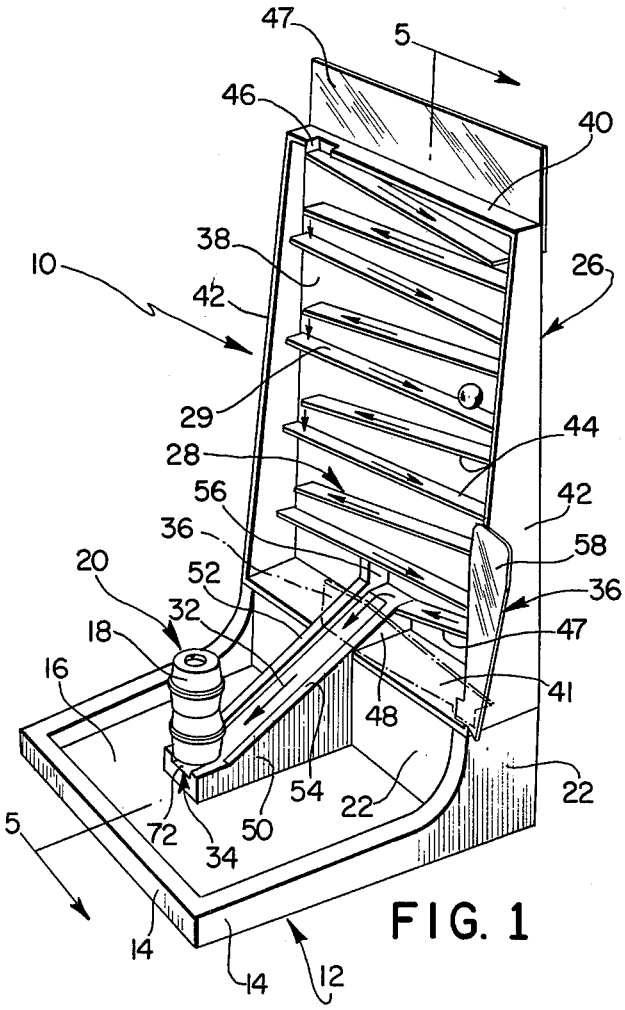
FIG. 1
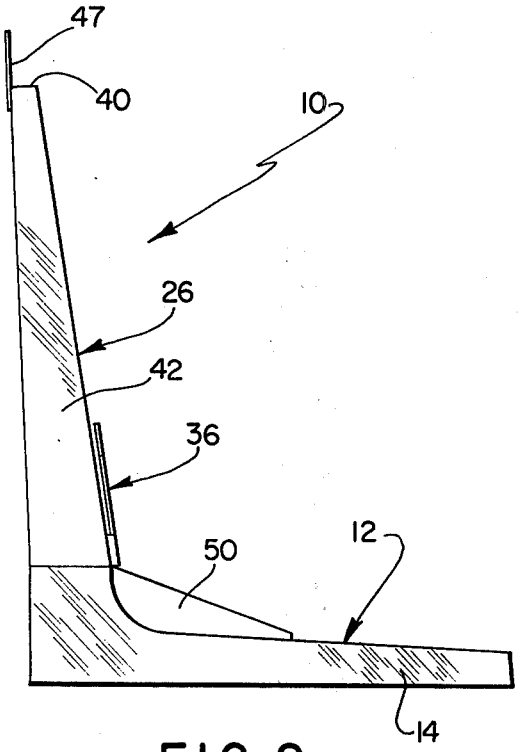
FIG. 2
FIG. 3
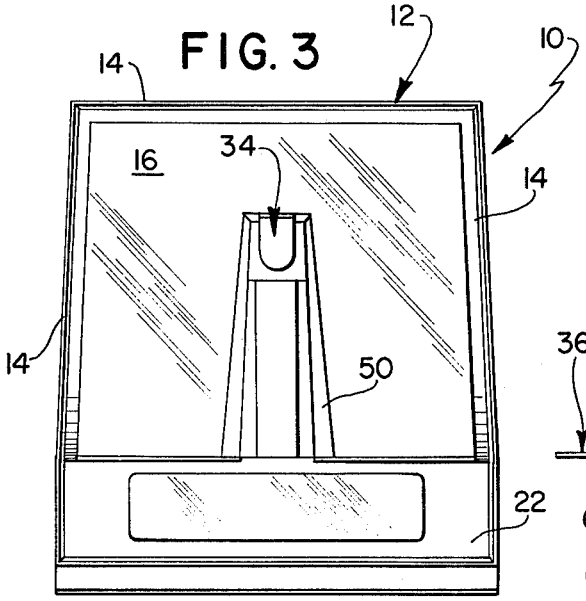
FIG. 4
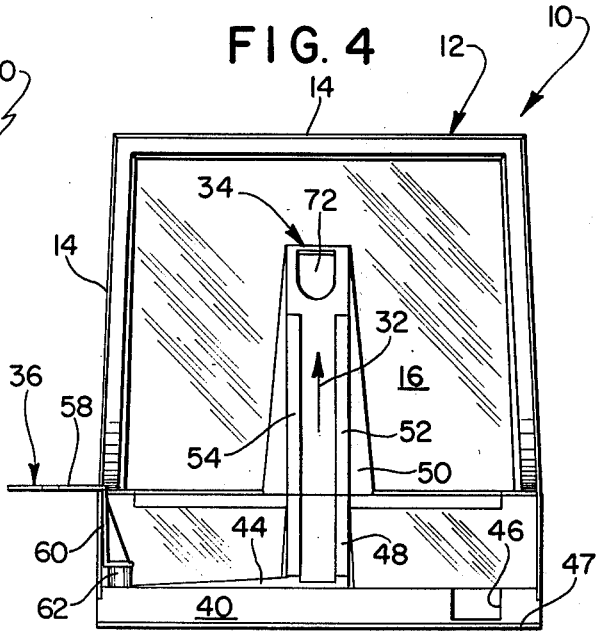

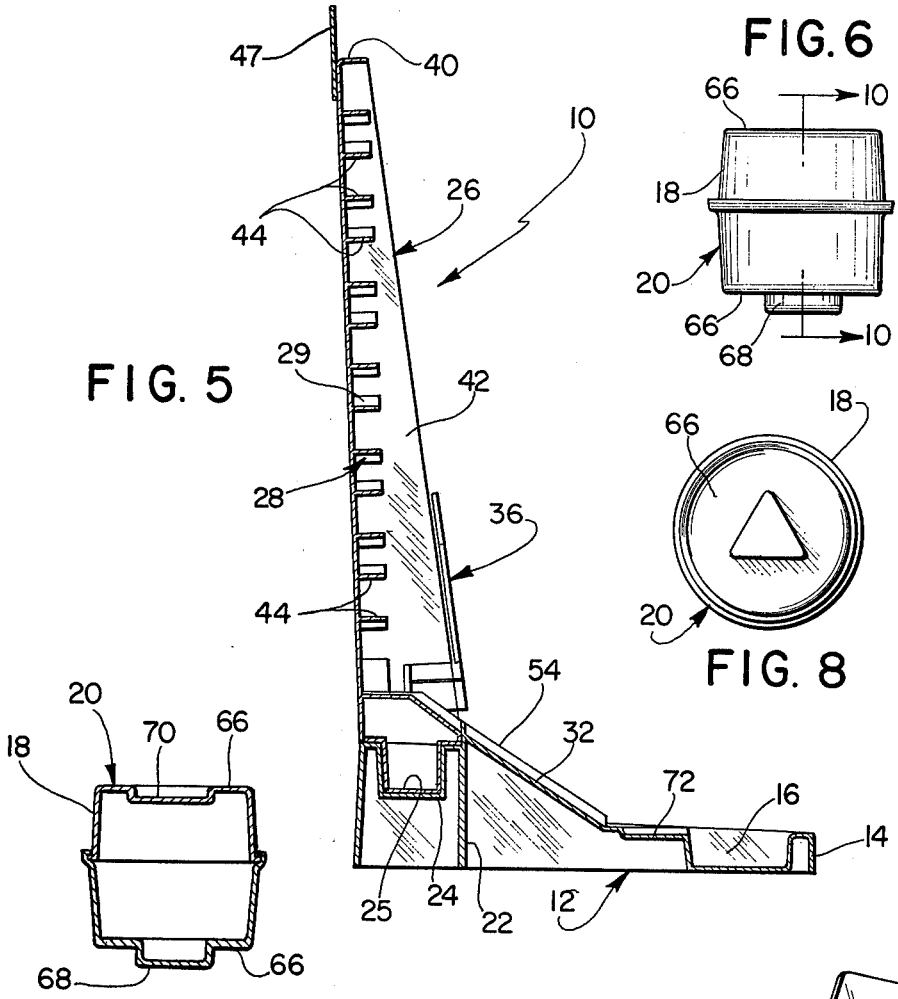
FIG. 5
FIG. 6
FIG. 7
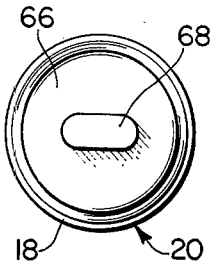
FIG. 8
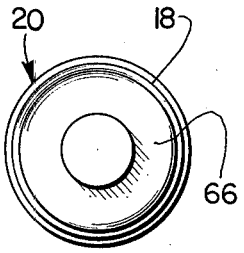
FIG. 9
FIG. 10
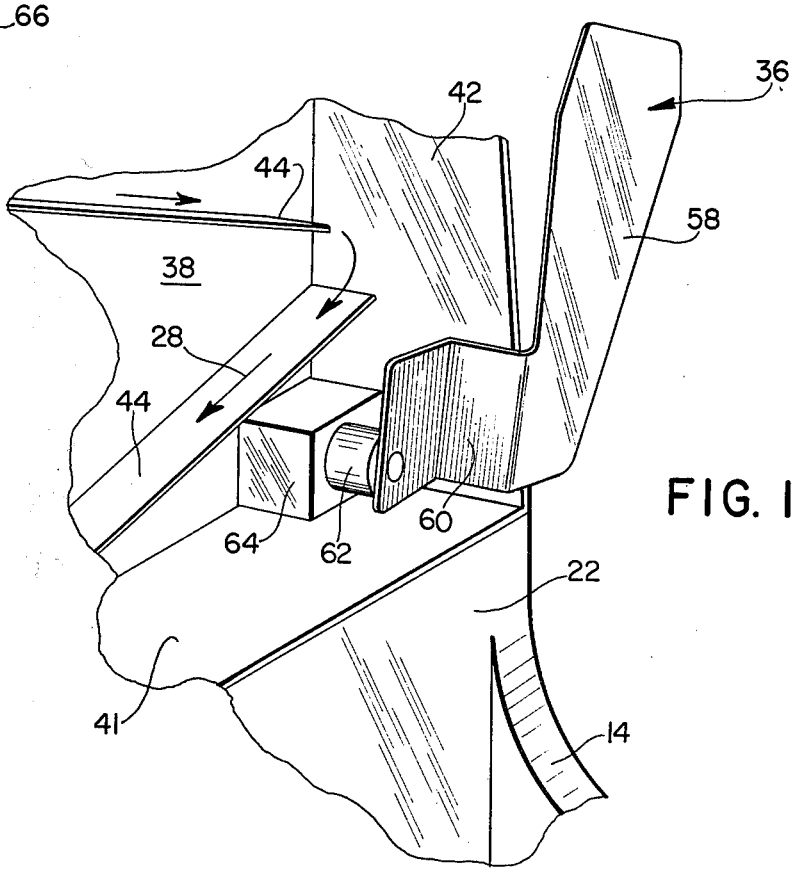
FIG. 11

TIMED STACKING GAME

BACKGROUND AND SUMMARY OF THE INVENTION

This invention relates to a game wherein construction pieces are assembled in stacked relationship, and particularly to such a stacking game wherein the stack is assembled in a race against time, i.e., the amount of time that it takes a ball to complete its downward descent along a trackway, the end of which comprises a platform on which the stack is assembled.

Game structures incorporating some of the above indicated features are generally known. For instance, it is generally known to time various participants of a game including stacking or other related assembly tasks so as to add an element of excitement and/or tension to the individual participants and to the overall game activity. Generally, however, the timing devices or mechanisms utilized in such games have been traditional timing means, such as hour glasses, clocks or the like which perform their timing function completely independently of the game itself. Expressed differently, there is no functional or physical interrelationship between the timing means and the play of the game, whether the latter comprises the stacking or other composite assembly of pieces. It is accordingly believed that if the time and game aspects could be directly interrelated in a functional manner, the result would be a game of enhanced playability, excitement and interest.

It is therefore a primary object of the present invention to provide a game in which construction pieces are assembled in a selected area in such a manner that the timing element of a functionally related timing mechanism associated therewith will, if permitted to complete the full extent of its timing path, physically engage the assembled pieces to cause same to collapse.

A further object of the present invention is the provision of a game of the aforementioned type in which a timing element moving along a timing path provides the timing function for a game having a primary function of assembling a plurality of construction pieces, wherein such timing element, in the form of a game piece, will interrupt the assembly function if permitted to travel the full extent of the path.

A still further object of the present invention is the provision of a game in which construction pieces are stacked in general vertical relationship with each other, which activity is timed by means of a game piece descending an elevated path which communicates with the stacked pieces, whereby said game piece will engage said stack and cause same to collapse unless its movement along the path is arrested prior to reaching said stack.

Still another object of the present invention is the provision of a game of the aforementioned type in which the area in which the primary game function, such as stacking, construction or the like is performed, is in the path of the descending game piece, and such path and the movement of the game piece therealong is readily observable by the game participants so that the potentially destructive movement of the game piece will enhance the excitement of the game play.

A further object of the present invention is the provision of a game construction of the character described wherein the playability thereof is increased by the provision of stackable construction pieces having variously shaped interfitting surfaces, so that the game participant, when forming a stack, must be careful to interengage complementary pieces.

These and other objects of the invention are accomplished by the provision of a game including a plurality of separate construction pieces capable of being assembled to form a composite and readily collapsible structure, a game base having a selected area thereof for supporting said structure, and a timing mechanism functionally and operatively associated with said base, said timing mechanism including a path and a timing element in the form of a game piece adapted to gravitationally travel said path in a predetermined time from a starting point to a terminal point thereof, said selected area being located in said path adjacent the terminal point thereof so as to permit the game piece to engage and upset the composite structure. Manually operable means are provided for blocking and hence stopping the descent of the game piece, the idea of the game being to complete the structure and stop descent of the game piece before the latter reaches and engages the game piece to cause it to collapse.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of a game apparatus constructed in accordance with the present invention;

FIG. 2 is a side elevational view thereof;

FIG. 3 is a top plan view of the base portion of such game;

FIG. 4 is a top plan view of the base and timing mechanism portions of the game in assembled position such as shown in FIG. 1;

FIG. 5 is a cross-sectional elevational view taken along the line 5—5 of FIG. 1;

FIG. 6 is an elevational view of one of the construction pieces utilized to form a stacked structure;

FIGS. 7 through 9 are plan views showing several of the shapes which the interengaging portions of the construction pieces may take;

FIG. 10 is a cross-sectional view of one of the construction pieces taken along the line 10—10, of FIG. 6; and FIG. 11 is an enlarged perspective view of a portion of the game apparatus showing in particular the device for interrupting movement of the game piece.

DESCRIPTION OF THE INVENTION

FIG. 1 of the drawings shows a preferred construction of the present game apparatus 10 in fully assembled position. Such apparatus includes a base 12 generally provided with upstanding side walls 14 so as to define an enclosed combination assembly and storage area for a plurality of construction pieces 18, two of which are shown in assembled position to form a stacked structure 20. The rear portion of the base 12 is provided with an upstanding portion 22 having a recess 24 on the top surface thereof for receipt of the portion of the game, shown generally at 26, as by interengagement of complementary shaped portion 25 within recess 24, as best shown in FIG. 5.

The overall construction of the timing means 26 is such so as to provide a generally zig zag path 28 defined by track members 29 down which a game piece such as a marble or a small steel ball 30 may gravitationally descend. The path is in a generally vertical plane and the game piece descends therealong by gravity in a predetermined time dependent on various known gravitational factors. The path 28 includes a straight, downwardly inclined terminal portion 32 which ends in a horizontal platform 34, on which the construction pieces 18 are adapted to be stacked. Thus, the game piece 30, if permitted to travel the full extent of the path 28, including the terminal portion 32 thereof, will knock down, upset or disassemble that portion of the structure 20 that has been assembled on the platform 34. Additionally, the game 10 includes manually operable stop means, such as the flag 36, operable to block or interrupt the travel of the game piece 30 along path 28, preferably by blocking the terminal portion 32 thereof.

The timing means 26 is generally in the form of a container including a rear wall 38 from which upper and lower end walls 40 and 41, respectively, and side walls 42 extend. The rear wall 38 is in turn provided with a series of path segments or tracks 29 extending from one side wall 42 towards and terminating short of the opposite side wall 42, and downwardly slanted so as to define a generally zig zag path down which the game piece 30 will gravitationally descend. Preferably, the timing means 26 when assembled to the base 12, is tilted slightly rearwardly so that the game piece 30, such as a marble, steel ball etc. will rest in part against the rear wall 38 while descending along the path 28. It should also be pointed out that at the end of each path segment or track 29 the ball or other game piece, because of the spacing from the proximate side wall 42, is free to drop onto the next ramp segment 29 so as to continue its downward descent. Entry of the ball 30 to the initial ramp segment may be had by means of an inwardly extending notch 46 formed within the upper wall 40.

The timing means 26 is further provided with a ramp portion 48 which communicates with the lowermost disposed path segment 47 so as to enable the ball 30 to move from the path 28 into the terminal path portion 32, and thus to platform 34, if uninterrupted. For this purpose the ramp portion 48 extends outwardly towards the base 12 into mating communication with ramp portion 50 provided on base 12 so as to, in effect, form the terminal path portion 32. The bottom of such downwardly inclined terminal ramp portion 50 includes the platform 34. The opposite sides of the terminal base portions 48, 50 may be provided with upstanding side rails 52 and 54, respectively, the ends of which abut each other and form a continuing structure which further serves to confine and direct the motion of the game piece 30 along the terminal path portion 32. Also, as it is preferable to position the terminal path portion 32 generally centrally of the lateral extent of the timing means 26, a wall 56 is provided to deflect the lateral movement of the ball 30 from the last remaining path segment 47 onto the ramp portion 48.

As shown most clearly in FIGS. 1 and 11, the stop means 36 comprises an arm or flag 58 having a generally L-shaped extension 60 pivotally mounted as at 62 to block 64 which in turn is secured to wall 38 by any suitable means. The flag 36 is adapted to be moved pivotally from an inactive, generally vertically orientated position, as shown in FIG. 11 and in the solid line representation in FIG. 1, to a blocking position as depicted by the phantom line representation in FIG. 1. In such blocking position the flag 36 serves to block or interrupt a portion of the path 28, namely the terminal portion 32 thereof, and in this way, when activated, as by a player participant, serves to block further descent of the game piece 30.

As best shown in FIGS. 6 through 10 of the drawings, the construction pieces 18 may take the form of barrel-like objects having opposed surfaces 66 respectively provided with either an outwardly extending element 68 or an inwardly extending recess 70, which element and recess are adapted to cooperatively interfit with each other. Furthermore, and in order to provide an added degree of complexity and excitement to the stacking task of the game, the recesses and elements 70, 68, respectively, may take different geometric forms, i.e. so that an element 68 in the form of a triangle, as shown in FIG. 8, must be matched with a similarly shaped recess in order to assemble those particular pieces 18. Furthermore, the platform 34 is preferably provided with a recess 72 of a width equal to or slightly greater than the largest lateral extent of the various geometric configurations chosen for the elements 68, including those shown in FIGS. 7, 8 and 9 of the drawings. Thus, if the lowermost piece 18 is positioned on platform 34 with its male portion 68 downwardly disposed, the recess 72 will receive the portion 68 therein, thus permitting the piece 18 to be flat on the platform 34.

In operation, a game participant initiates play by dropping the ball 30 in the slot 46 so as to initiate the timing mechanism 26. As the ball progressively descends along the zig zag path portion 28, that same participant or another player attempts to assemble, that is stack, either a previously estimated number of construction pieces 18, or as many as possible, prior to the timing element moving completely through path portions 28 and 32 and reaching platform 34 so as to roll into the stacked structure 20 causing same to collapse. If the participant doing the stacking chooses, he may at any time actuate the flag 36 so as to prevent the ball from reaching the stack 20, the object being either to complete a stack structure comprising a predetermined number of pieces 18, in which event the player would then actuate the flag 36, or else to stack as many pieces as possible before the ball 30 engages the stack and causes it to collapse. In the former play of the game, the player doing the stacking would state beforehand how many pieces he or she believes they could stack, and then the player who successfully makes the highest bid, would be the winner. In the latter version, competing players would simply attempt to stack as many pieces as possible within the time allotted by the timing means 26, and the one stacking the most would be the winner. In any event, the necessity of stacking pieces 18 having complementary shaped male and female portions 68 and 70 further enhances the excitement and tension involved.

In the play of the game as outlined above, not only does the complete observability of the descent of the ball 30 enhance the excitement and interject an aspect of tension into the game, but the audible sound that the ball makes as it falls from one path segment 29 to the next creates an added dimension of excitement; therefore, creating not only a race against visually observable time but also one against audibly discernible time as well. In this regard, part or all of the zig zag path portion 28 may be obscured from the view of the stacking participant, so that only the second of the ball falling onto each path segment 29 thereof will be discernible.

Also, in such alternative constructions the path 28 may be designed to be visually observable only from the rear so that only the participants' competitors may fully observe the timing mechanism. Also, instead of alternately spacing adjacent ramp segments from their respective side walls 42, openings may be provided intermediate the ends of tracks 29 or the ball may be caused to descend in other trajectories or paths, i.e. spiral and the like. Furthermore, while the game piece 30 has herein been referred to as a spherical rolling object such as a ball, marble, etc., it should be clear that it may take other forms and move in alternate ways as by sliding or as by being propelled by forces other than gravity.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A game wherein construction pieces are assembled in a race against time to test the combined skill, dexterity and judgment of individual or group players, including a plurality of separate construction pieces capable of being assembled to form a readily collapsible composite structure, a base having a selected area thereof for supporting said structure, and a timing mechanism operatively associated with said base, said timing mechanism and said base cooperatively forming a path, and a movable game piece adapted to travel said path from a starting point thereof to a terminal portion thereof, said terminal portion of said path intersecting said construction support area so that said game piece may engage and impact said structure to cause same to collapse, said timing mechanism comprising an elevated path and said game piece adapted to descend along said path by means of gravity, said timing mechanism further including a housing supported by said base in a generally elevated position relative thereto, said housing comprising a vertically disposed, rearwardly inclined wall, a plurality of downwardly inclined track members secured to said wall and defining a zig zag path whereby said game piece is adapted to progressively move from said starting point along each of said track members to said terminal path portion, said terminal path portion comprising a ramp extending between said selected area and said zig zag path portion, said ramp including a first ramp segment forming a continuation of said zig zag path portion directed from said housing towards said base and a second ramp segment disposed on said base, the bottom of said second ramp segment having a platform defining said selected construction area, and stop means adapted for positioning generally between said ramp segments to stop the movement of said descending game piece from reaching said construction area.

2. A game wherein construction pieces are assembled in a race against time to test the combined skill, dexterity and judgment of individual or group players, including a plurality of separate construction pieces capable of being assembled to form a readily collapsible composite structure, a base having a selected area thereof for supporting said structure, and a timing mechanism operatively associated with said base, said timing mechanism and said base cooperatively forming a path, and a movable game piece adapted to travel said path from a starting point thereof to a terminal portion thereof, said terminal portion of said path intersecting said construction support area so that said game piece may engage and impact said structure to cause same to collapse, said construction pieces each having opposed assembly surfaces, one of said surfaces having an outwardly extending element and the other of said surfaces having an inwardly extending recess for interengagement with a complementary shaped element of another construction piece, said selected base area including an elevated platform having recessed means adapted to receive the outwardly extending element of the lowermost construction piece stacked thereon, said construction pieces collectively including a plurality of differently shaped elements and recesses, thereby increasing the difficulty of assembling said pieces into a composite stack or structure.

3. A game wherein construction pieces are assembled in a race against time to test the combined skill, dexterity and judgment of individual or group players, including a plurality of separate construction pieces capable of being assembled to form a readily collapsible composite structure, a base having a selected area thereof for supporting said structure, and a timing mechanism operatively associated with said base, said timing mechanism and said base cooperatively forming a path, and a movable game piece adapted to travel said path from a starting point thereof to a terminal portion thereof, said terminal portion of said path intersecting said construction support area so that said game piece may engage and impact said structure to cause same to collapse, said timing mechanism comprising an elevated path and said game piece adapted to descend along said path by means of gravity, said timing mechanism including a housing supported by said base in a generally elevated position relative thereto, said housing comprising a vertically disposed, rearwardly inclined wall, a plurality of downwardly inclined track members secured to said wall and defining a zig zag path whereby said game piece is adapted to progressively move from said starting point along each of said track members to said terminal path portion, said housing having sides upstanding from said wall on either side thereof, said track members each terminating short of said sides so as to provide spaces to permit the descending game piece to drop from the end of one track member to the beginning of the next lower one, wherein said path and said game piece as it descends therealong are at least partially obscured when viewed from the front.

* * * * *